US008907300B2

(12) United States Patent
Radovanov et al.

(10) Patent No.: US 8,907,300 B2
(45) Date of Patent: Dec. 9, 2014

(54) SYSTEM AND METHOD FOR PLASMA CONTROL USING BOUNDARY ELECTRODE

(71) Applicant: Varian Semiconductor Equipment Associates, Inc., Gloucester, MA (US)

(72) Inventors: Svetlana B. Radovanov, Brookline, MA (US); Ludovic Godet, Boston, MA (US); Tyler Rockwell, Wakefield, MA (US); Chris Campbell, Newburyport, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 27 days.

(21) Appl. No.: 13/826,178

(22) Filed: Mar. 14, 2013

(65) Prior Publication Data

US 2014/0265853 A1 Sep. 18, 2014

(51) Int. Cl.
*H01J 27/00* (2006.01)
*H01J 27/02* (2006.01)

(52) U.S. Cl.
CPC ..... *H01J 27/024* (2013.01)
USPC .... 250/423 R; 250/282; 250/288; 250/492.3; 250/424; 250/492.21; 250/492.22; 250/396 R

(58) Field of Classification Search
USPC ..... 250/288, 282, 423 R, 424, 492.3, 250/492.21, 492.22, 396 R
See application file for complete search history.

(56) References Cited

U.S. PATENT DOCUMENTS 7,176,469 B2 * 2/2007 Leung et al. ..... 250/423 R
2004/0104683 A1 6/2004 Leung et al.
2005/0093460 A1 5/2005 Kim et al.
2011/0100798 A1 5/2011 Boswell
2011/0226422 A1 9/2011 Kwan et al.

FOREIGN PATENT DOCUMENTS

WO 2010008598 A1 1/2010

OTHER PUBLICATIONS

Logue, Michael D., et al, Ion Energy Distributions in Inductively Coupled Plasmas Having a Biased Boundary Electrode, Plasma Sources Science and Technology, 2012, pp. 1-13, vol. 21, IOP Publishing, United Kingdom.
Shin, Syungjoo, et al., Control of Ion Energy Distributions Using a Pulsed Plasma with Synchronous Bias on a Boundary Electrode, Plasma Sources Science and Technology, 2011, pp. 1-9. vol. 20, IOP Publishing, United Kingdom.
International Search Report and Written Opinion, mailed Aug. 19, 2014 for PCT/US20141024003, filed Mar. 12 2014.

* cited by examiner

*Primary Examiner* — Jack Berman
*Assistant Examiner* — Meenakshi Sahu

(57) ABSTRACT

An ion source may include a chamber configured to house a plasma comprising ions to be directed to a substrate and an extraction power supply configured to apply an extraction terminal voltage to the plasma chamber with respect to a voltage of a substrate positioned downstream of the chamber. The system may further include a boundary electrode voltage supply configured to generate a boundary electrode voltage different than the extraction terminal voltage, and a boundary electrode disposed within the chamber and electrically coupled to the boundary electrode voltage supply, the boundary electrode configured to alter plasma potential of the plasma when the boundary electrode voltage is received.

21 Claims, 9 Drawing Sheets

FIG. 4A
CHAMBER
FIG. 4B
BOUNDARY ELECTRODE
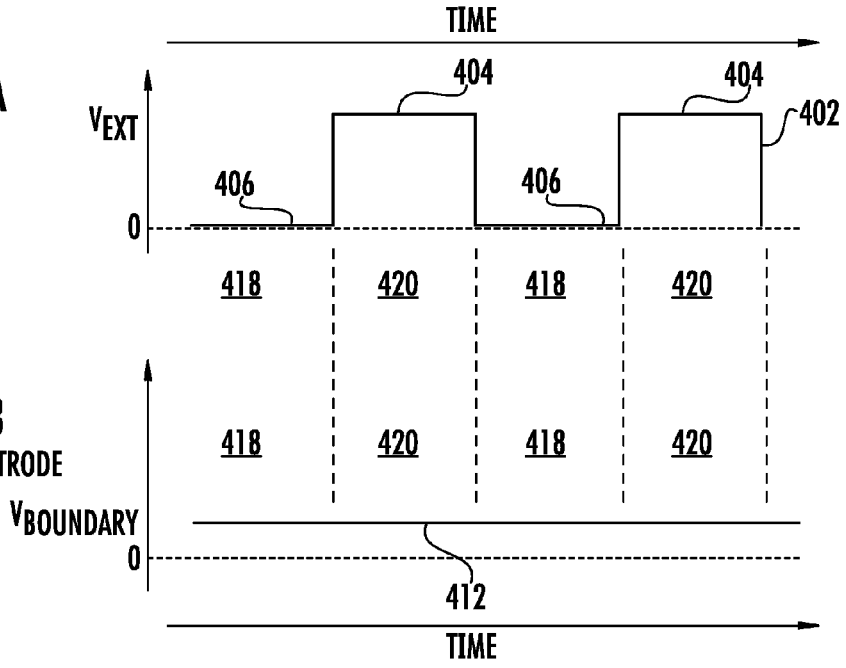
FIG. 5A
CHAMBER
FIG. 5B
BOUNDARY ELECTRODE
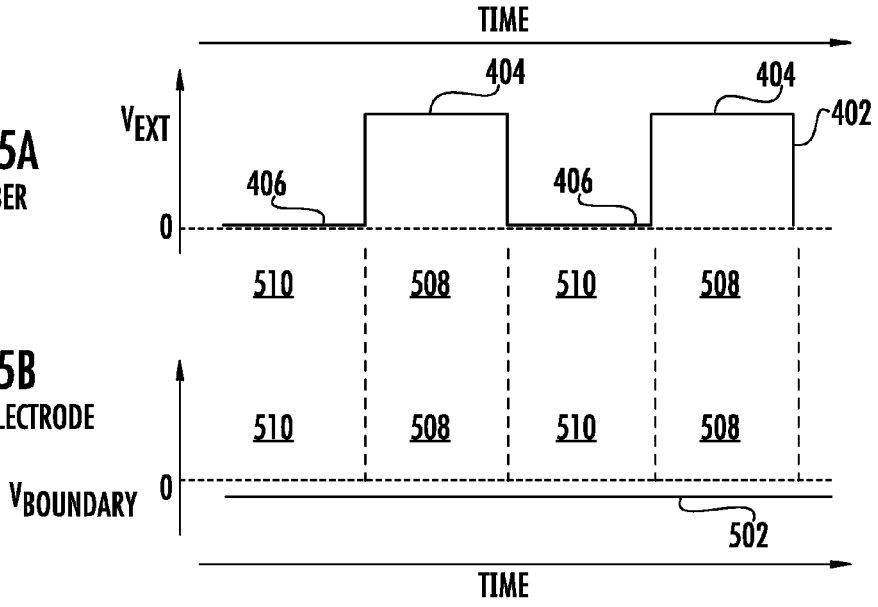

CHAMBER

BOUNDARY ELECTRODE

CHAMBER

BOUNDARY ELECTRODE

FIG. 8A
CHAMBER
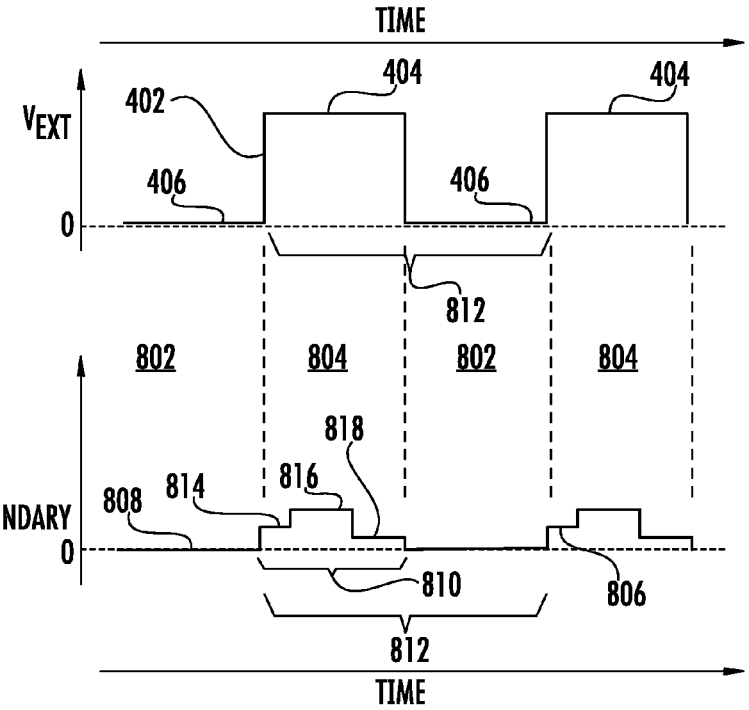
FIG. 8B
BOUNDARY ELECTRODE
FIG. 9A
CHAMBER
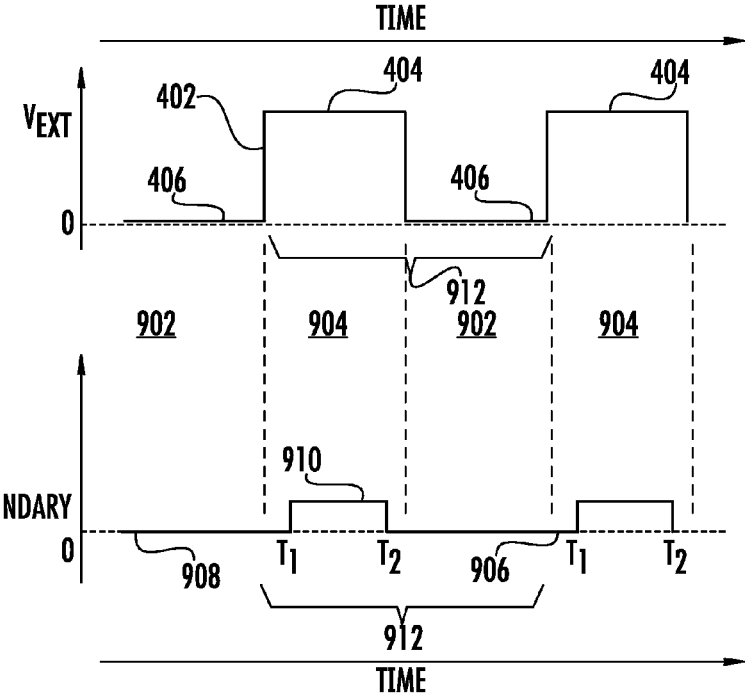
FIG. 9B
BOUNDARY ELECTRODE

SYSTEM AND METHOD FOR PLASMA CONTROL USING BOUNDARY ELECTRODE

BACKGROUND OF THE INVENTION

1. Field of the Invention

Embodiments of the invention relate to the field of substrate processing using ions. More particularly, the present invention relates to a method and system for using electrodes to modify a plasma to provide ions to a substrate.

2. Discussion of Related Art

In many present day ion processing apparatus, including plasma doping (PLAD) tools and tools that employ plasma sheath modifiers the substrates are arranged close to an ion source or plasma chamber. These conventional systems are employed to perform both ion implantation as well as thin film deposition on a substrate. In such systems the propagation distance for ions extracted from an ion source may be on the order of a few centimeters or less. Accordingly, variation in plasma properties including spatial non-uniformities and time dependent variation of plasmas may strongly affect substrate processing.

In some cases, ions may be extracted in the form of a ribbon beam having a cross section that is elongated in one direction. To process substrates over a large area a ribbon beam may be scanned with respect to a substrate while an implantation process is performed. In order to process such substrates uniformly it is desirable to control spatial uniformity of ions within a ribbon beam extracted from a plasma chamber. In addition, in present day systems that employ pulsed processing in which pulses of ions are provided to a substrate, it is desirable to accurately control ion current and dose provided to a substrate. In pulse operation it has been observed that ion current persists during OFF portions of a pulse leading to greater ion dose than calculated assuming a duty cycle based upon nominal ON and OFF portions of a pulse period. Moreover, mean ion energy during OFF portions may persist such that the substrate is exposed to undesired processing such as chemical etching of physical sputtering during OFF portions. In view of the above, it will be appreciated that there is a need to develop additional control capability of ion sources including pulsed type ion processes.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An ion source may include a chamber configured to house a plasma comprising ions to be directed to a substrate and an extraction power supply configured to apply an extraction terminal voltage to the plasma chamber with respect to a voltage of a substrate positioned downstream of the chamber. The system may further include a boundary electrode voltage supply configured to generate a boundary electrode voltage different than the extraction terminal voltage, and a boundary electrode disposed within the chamber and electrically coupled to the boundary electrode voltage supply, the boundary electrode configured to alter plasma potential of the plasma when the boundary electrode voltage is received.

In another embodiment, a method of processing a substrate includes generating a plasma in a plasma chamber, the plasma comprising ions to be directed to the substrate, applying an extraction terminal voltage between the chamber and substrate, the extraction terminal voltage effective to generate a first plasma potential in the plasma, and generating a boundary electrode voltage at a boundary electrode disposed within the chamber, the boundary electrode voltage different than the extraction terminal voltage and generated at least partially during the applying the extraction terminal voltage, the boundary electrode voltage effective to generate a second potential for the plasma that is different from the first plasma potential.

BRIEF DESCRIPTION OF THE DRAWINGS

FIG. 4A depicts an exemplary extraction terminal voltage signal;

FIG. 4B depicts an exemplary boundary electrode voltage signal that may be used in conjunction with the extraction terminal voltage signal of FIG. 4A;

FIG. 5A depicts an exemplary extraction terminal voltage signal;

FIG. 5B depicts another exemplary boundary electrode voltage signal that may be used in conjunction with the extraction terminal voltage signal of FIG. 5A;

FIG. 8A depicts an exemplary extraction terminal voltage signal;

FIG. 8B depicts a further exemplary boundary electrode voltage signal that may be used in conjunction with the extraction terminal voltage signal of FIG. 8A;

FIG. 9A depicts an exemplary extraction terminal voltage signal;

FIG. 9B depicts a still further exemplary boundary electrode voltage signal that may be used in conjunction with the extraction terminal voltage signal of FIG. 9A;

DESCRIPTION OF EMBODIMENTS

Figure 1:
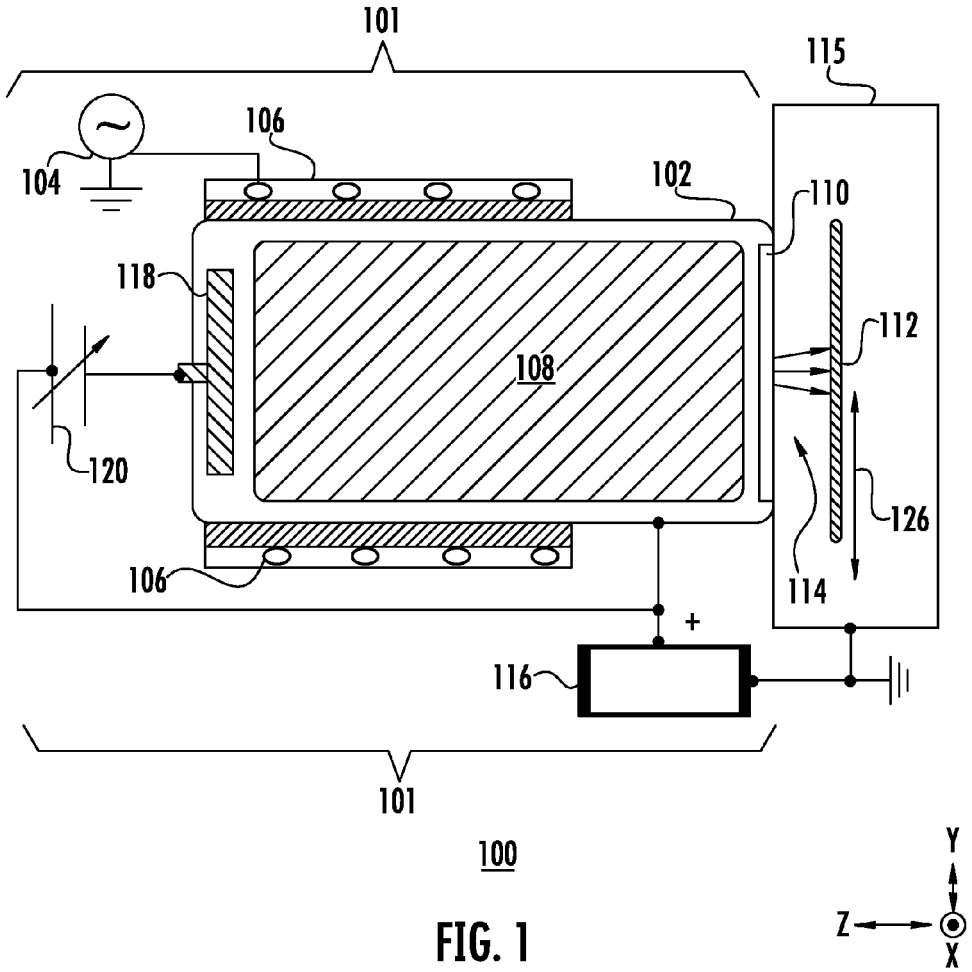
FIG. 1 is a schematic depiction of a exemplary processing system consistent with the present embodiments.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

In accordance with the present embodiments, processing systems such as plasma-based systems are provided with one or more boundary electrodes that facilitate adjustment of plasma properties. In particular, as detailed below a boundary electrode(s) may be arranged within a desired region of a plasma chamber in order to perform local and/or global adjustments to the plasma in a manner not achieved by conventional tools used to generate ions. The boundary electrode may, for example adjust plasma potential, ion energy distribution (IED), and/or ion/electron loss within the plasma. These adjustments may be harnessed to tailor ion energy and ion flux uniformity, among other features, for ion beams extracted from such plasmas.

As detailed below, advantages afforded by the present embodiments include independent control of plasma potential of a plasma processing system, including for both continuous wave (CW) and pulsed operation modes. Control of plasma potential in a plasma processing system using boundary electrodes affords the ability to process substrates more uniformly and accurately when exposed to ions extracted from the plasma. In current day ribbon beam style apparatus, for example, substrate charging and dose uniformity depend upon plasma potential and ion flux uniformity for a plasma. The boundary electrodes of the present embodiments facilitate adjustment of these parameters in a manner that improves dose uniformity and reduces unwanted substrate charging. In particular, in pulsed processing, the boundary electrodes can be employed to reduce OFF portion ion flux and/or OFF portion ion energy of ions directed to a substrate. In conventional systems excessive ion energy or ion flux during OFF portions may be a source of unwanted substrate etching and ion dose error, respectively.

Using boundary electrodes of the present embodiments, in an OFF portion of a pulse signal, ion flux can be suppressed and the peak of ion energy of ions incident on a substrate shifted to a lower ion energy by biasing the boundary electrode with respect to an extraction power supply and/or local ground potential. This advantage is especially useful because the boundary electrode can provide a reference ground for a plasma to control plasma potential, including in scenarios in which plasma chamber walls may become coated with an insulator and a plasma aperture is insulating. A further advantage detailed below is the local control of ion density within portions of a plasma proximate the boundary electrode(s) provided by boundary electrodes of the present embodiments facilitate. In this manner, the spatial uniformity of ions within a plasma, and thereby uniformity of ions within an extracted beam, can be controlled.

In various embodiments, a set of one or more boundary electrodes are distributed either fixedly or movably within a plasma chamber of a plasma processing system. A boundary electrode contains a conducting surface that is electrically coupled to a boundary electrode voltage supply that is configured to supply a boundary electrode voltage different than the voltage applied to a plasma chamber that houses the boundary electrode.

FIG. 1 depicts an exemplary processing system 100 consistent with the present embodiments. The processing system 100 includes an ion source 101 and process chamber 115 that is configured to house a substrate 112. The ion source 101 contains a chamber to generate a plasma from which an ion beam is extracted, which chamber is termed a plasma chamber 102. The ion source 101 also includes a power supply 104 configured to power the plasma chamber 102. In this embodiment, the power supply 102 is an RF power supply. The power supply 104 directs power to the RF coil 106, which ignites a plasma 108 when the appropriate gaseous species (not shown) is provided in the plasma chamber 102. Although FIG. 1 depicts that the plasma 108 is generated by an RF coil 106, in other embodiments other known techniques may be used to generate the plasma 108. For example, a plasma source for the plasma 108 may, in various embodiments, be an in situ or remote, inductively coupled plasma source, capacitively coupled plasma source, helicon source, microwave source, or any other type of plasma source. The embodiments are not limited in this context.

Turning now to the plasma chamber 102, there is shown an extraction plate 110 that is provided with one or more apertures (not shown) to extract an ion beam 114 from the plasma 108 and direct the ion beam 114 to the substrate 112. The substrate 112 may be coupled to a substrate holder/stage (not shown) that is operative to move the substrate 112 along at least the direction 126, which is parallel to the Y-direction of the Cartesian coordinate system shown. The ion source 101 also includes an extraction power supply 116, which is electrically coupled to the plasma chamber 102. The extraction power supply 116 is configured to supply an extraction voltage, termed herein an "extraction terminal voltage," to the plasma chamber 102, which is a positive voltage in the case that plasma 108 is a positive ion plasma. When the extraction power supply 116 generates an extraction terminal voltage ($V_{EXT}$) at the plasma chamber 102, the plasma potential $V_P$ of the plasma 108 acquires a potential (voltage) that is slightly more positive than the inside walls of the plasma chamber. In an example in which the substrate 112 is grounded, and the extraction terminal voltage $V_{EXT}$ is +2000 V, $V_P$ may equal about +10 V or about +80 V in different examples, depending upon the exact configuration of the plasma chamber 102, the plasma power, gas pressure in the plasma chamber 102, and so forth. If the substrate 112 is grounded, the extraction terminal voltage $V_{EXT}$ of +2000 V generated by the extraction power supply is essentially applied between the plasma chamber 102 and substrate 112. Accordingly, ions exiting plasma 108 may experience a net potential drop slightly greater than 2000 V between plasma 108 substrate 112.

As further shown in FIG. 1, a boundary electrode 118 is situated within the plasma chamber 102. In the particular example of FIG. 1, the boundary electrode 118 is situated at a position generally opposite to the extraction plate 110. The boundary electrode 118 is electrically conducting and is electrically coupled to a boundary electrode voltage supply 120 that is configured in various embodiments to generate a direct current (DC) boundary electrode voltage to the boundary electrode 118. As shown in FIG. 1, one terminal of the boundary electrode voltage supply 120 is coupled to the source terminal supplied by the extraction power supply 116 (and plasma chamber 102) such that when a voltage is applied across the boundary electrode voltage supply 120, the boundary electrode 118 is biased by the value of the applied boundary electrode voltage with respect to the source terminal. In different embodiments discussed in detail below, the boundary electrode voltage may be negative or positive with respect to the potential of the plasma chamber 102, and may be applied in a pulsed or CW manner to the boundary electrode 118.

When the boundary electrode voltage supply 120 applies to the boundary electrode 118 a negative or positive bias voltage, i.e., the boundary electrode voltage, the negative or positive bias acquired with respect to the plasma chamber 102 causes the boundary electrode 118 to act as a source or sink of current. This acts to locally modify plasma characteristics of the plasma 108 near the boundary electrode 118. In addition, the bias acquired by the boundary electrode 118 causes a shift in $V_P$ globally for the plasma 108. Thus, although located remotely from the extraction plate 110, the boundary electrode 118 of FIG. 1 may adjust the plasma potential $V_P$ of plasma 108 proximate the boundary extraction plate 110 and thereby modulate the potential drop between plasma 108 and substrate 112 and the resulting ion energy of ions of ion beam 114 as they impact substrate 112.

In various embodiments, the absolute value of the difference in boundary electrode voltage generated by the boundary electrode voltage supply 120 and extraction terminal voltage may range from 10 V to about 500 V. Moreover, in some embodiments, the ratio of surface area of the boundary electrode 118 to the internal wall area of the plasma chamber 102 may range from 1% to 30%.

Figure 2:
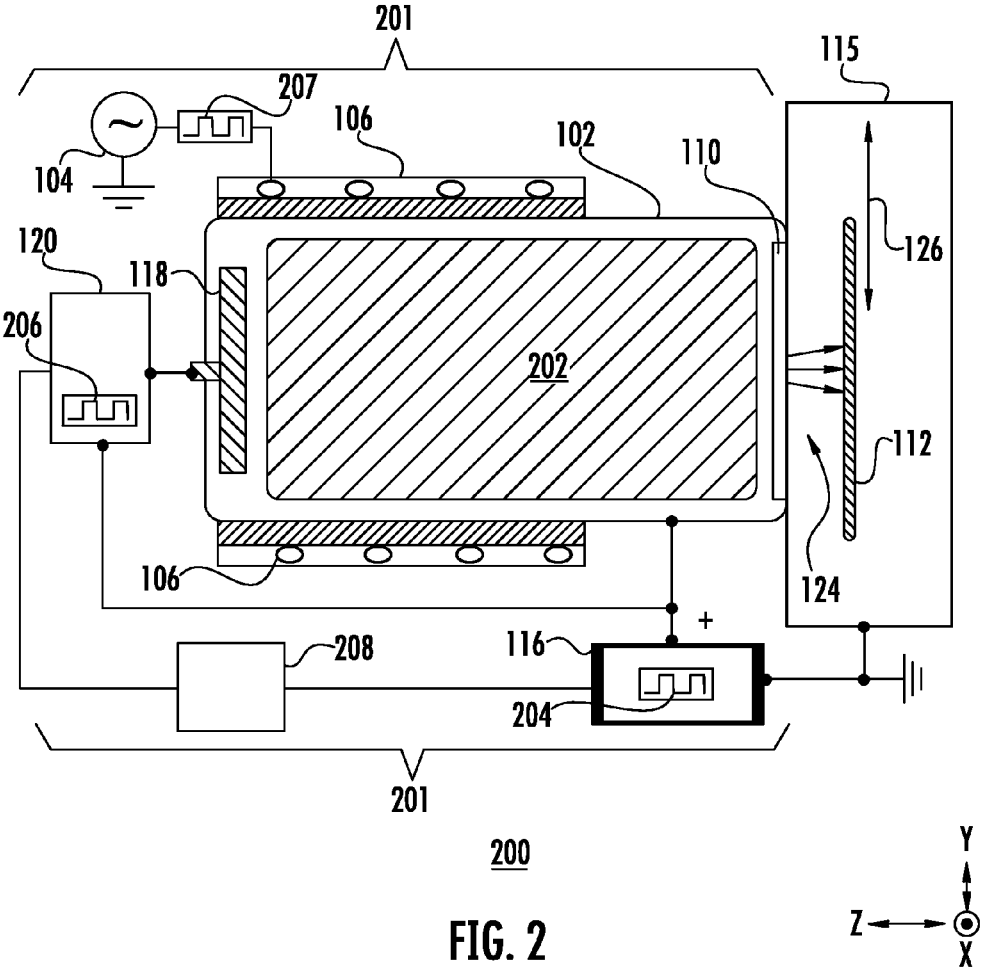
FIG. 2 is a schematic depiction of an exemplary processing system consistent with the present embodiments.

FIG. 2 depicts another exemplary processing system 200 consistent with the present embodiments. The processing system 200 represents a variant of the processing system 100 and shares the same components as processing system 100 except as otherwise noted. In particular, in processing system 200 the extraction power supply 116 of ion source 201 is configured to provide an extraction terminal voltage as a pulsed extraction signal 204. The pulsed extraction signal may be characterized by a pulse period that includes ON and OFF portions. In various embodiments, during each ON portion, a positive voltage is applied to the plasma chamber 102, and during each OFF portion, the plasma chamber 102 may be set to ground potential. Accordingly, since the substrate 112 may also be grounded, only during ON portions are ions 124 extracted and directed to the substrate 112 as a series of pulses in which the ions have an ion energy defined in large part by the extraction terminal voltage $V_{EXT}$. During OFF portions ions 124 are generally not extracted from the plasma chamber 102 and do not generally impact the substrate 112, although, as discussed below, some portion of ions may impact the substrate 112 and with an ion energy that may be significantly less than an energy of $V_{EXT}$.

As further shown in FIG. 2, the power supply 104 may also be configured to supply power to the processing system 200 as a series of pulses 207, which may be synchronized to the pulses generated by the extraction power supply 116. Thus, during ON portions, a plasma 202 may be ignited and extraction terminal voltage $V_{EXT}$ applied, while during OFF portions, the plasma 202 may be extinguished and the plasma chamber 102 grounded. In various embodiments, the extraction terminal voltage pulse period may span a duration of a few tens of microseconds to a few milliseconds. The duty cycle as defined by the relative duration of an ON portion to the total pulse period may be adjusted as desired.

When the substrate 112 is scanned along the direction 126 the substrate may accordingly be exposed to pulses of ions that impinge upon the substrate when the plasma 202 is ignited and extraction terminal voltage $V_{EXT}$ applied to the plasma chamber 102. In various embodiments, the duty cycle for power pulses from the RF power supply 104 and duty cycle for extraction terminal voltage ON portions may be adjusted, together with the scan speed to provide either blanket exposure of the substrate 112 to ions in which ion dose is uniform in the X-direction, or as patterned exposure in which ion dose varies along the X-direction. For example the OFF portion of an extraction terminal voltage signal may be increased, or the OFF portion may be extended over more than one pulse period, thus creating regions of the substrate that are unexposed to ions as the substrate is scanned adjacent the plasma chamber.

As further illustrated in FIG. 2 the boundary electrode voltage supply 120 is configured to supply a pulsed boundary electrode voltage signal 206 to the boundary electrode 118. In particular embodiments, the boundary electrode voltage supply 120 is configured to either supply a pulsed boundary electrode voltage signal 206 or to supply a CW voltage signal. As detailed below, the pulsed boundary electrode voltage signal 206 may supply a voltage during ON portions of a pulsed extraction signal 204 that differs from source terminal by 10 V to 500 V and is the same as extraction voltage terminal during OFF portions. To align the pulsed boundary electrode voltage signal 206 and pulsed extraction signal 204 the processing system 200 further includes a synchronizer 208. In various embodiments, the pulsed boundary electrode voltage signal 206 and pulsed extraction signal 204 may be configured to have the same pulse period. Accordingly, in various embodiments the synchronizer 208 may synchronize the pulsed boundary electrode voltage signal 206 and pulsed extraction signal 204 by aligning the beginning of respective periods of each signal. In this manner, an ON portion and OFF portion of the pulsed boundary electrode voltage signal 206 may align to a respective ON portion and OFF portion of the pulsed extraction signal 204.

Figure 3A:
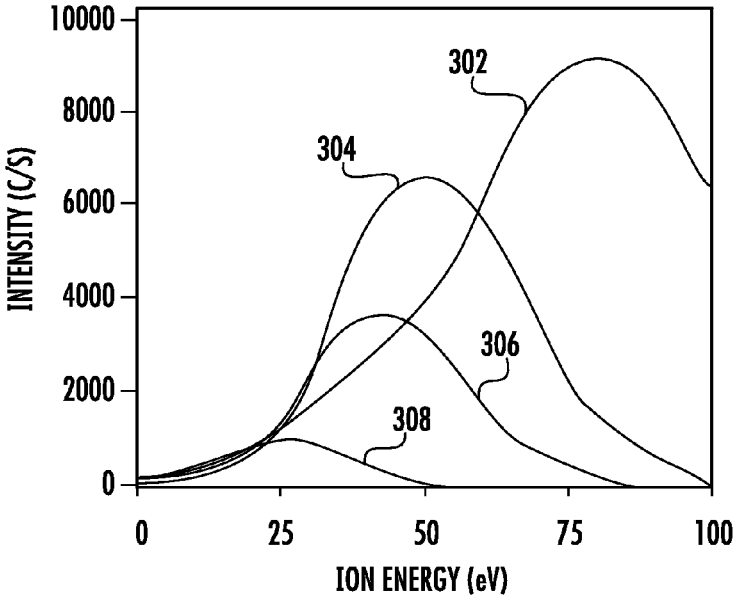
FIG. 3A is a graph that depicts ion energy distribution generated by an exemplary boundary electrode for a first set of conditions.

As noted above, in different embodiments the boundary electrode 118 may be biased either positively or negatively with respect to the terminal voltage applied to a plasma chamber by the extraction power supply 116. In embodiments that employ negatively biased boundary electrodes, the boundary electrode may serve as a sink to draw ions from a plasma and thereby alter plasma characteristics as well as distribution of charged particles transported to the substrate. Various experiments have been carried out to evaluate the changes in ion energetics caused by application of negative voltage to a boundary electrode. In particular, ion energy distributions were measured in a plasma OFF portion for a pulsed plasma using a single biased boundary electrode placed in a $B_2H_6/H_2$ inductively coupled plasma discharge and biased at various negative voltages. FIG. 3A presents graphical data showing simulated ion energy distribution for ions extracted from the plasma chamber as measured outside the plasma chamber. As illustrated by the curve 302, a reference condition in which no voltage is applied to the boundary electrode, average ion energy for positive ions is about 75 V. The curves 304 and 306 represent conditions of −25 V and −40 V bias applied to the boundary electrode. As shown, the peak intensity decreases and the average ion energy decreases with increased negative voltage up to −40 V. This indicates a large drop in total ion current caused by the application of negative voltage to the boundary electrode as determined by the decrease in area under curve 306, for example. At −60V, curve 308, an even more pronounced drop in ion current is evident as well as a large decrease in ion energy. It is therefore evident that ion density as well as ion energy may be strongly affected by application to a boundary electrode of a negative voltage in the range of a few tens of volts. In particular, a moderate negative boundary electrode voltage of a few tens of volts may be effective in reducing ion energy and/or ion current during OFF portions of a pulsed extraction terminal voltage signal, and thereby reduce unwanted ion treatment of the substrate.

Figure 3B:
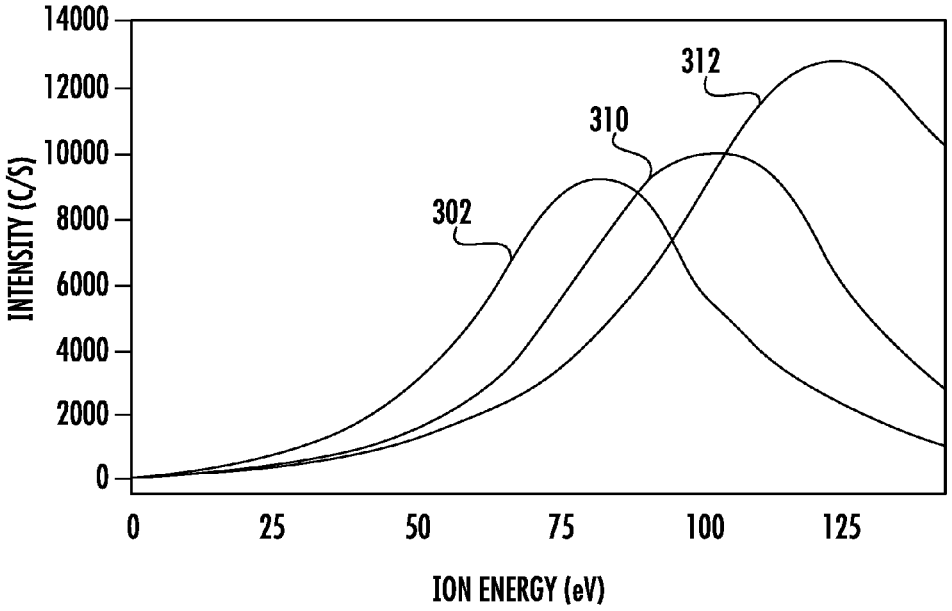
FIG. 3B is another graph that depicts ion energy distribution generated by an exemplary boundary electrode for another set of conditions.

In contrast, FIG. 3B presents simulation of behavior in which a positive voltage is applied to a boundary electrode arranged according to the aforementioned conditions with respect to FIG. 3A. In this case, an application of +30V to the boundary electrode (curve 310) shifts the average ion energy and the ion energy distribution upwardly which is even more pronounced at +60V (curve 312). Because the average energy of positive ions incident on a substrate is determined by a difference between the plasma potential in the plasma system from which the ions are extracted and the substrate potential, additional voltage applied on the boundary electrode is dropped across the plasma sheath. Therefore, a majority of positive ions gain additional velocity as they accelerate across the plasma sheath, resulting in an increase in total ion flux of ions measured as evidenced by the increased area under curve 312. This is further illustrated in FIG. 3C which depicts mass spectra of ions collected under conditions of no boundary electrode voltage (spectrum 320) and +120 V boundary electrode voltage (322). As shown therein the signal intensity for $H_3^+$, $B^+$, $BH_2^+$ and $B_2H_2^+$ all increase when +120 V is applied across the boundary electrode.

Figure 3C:
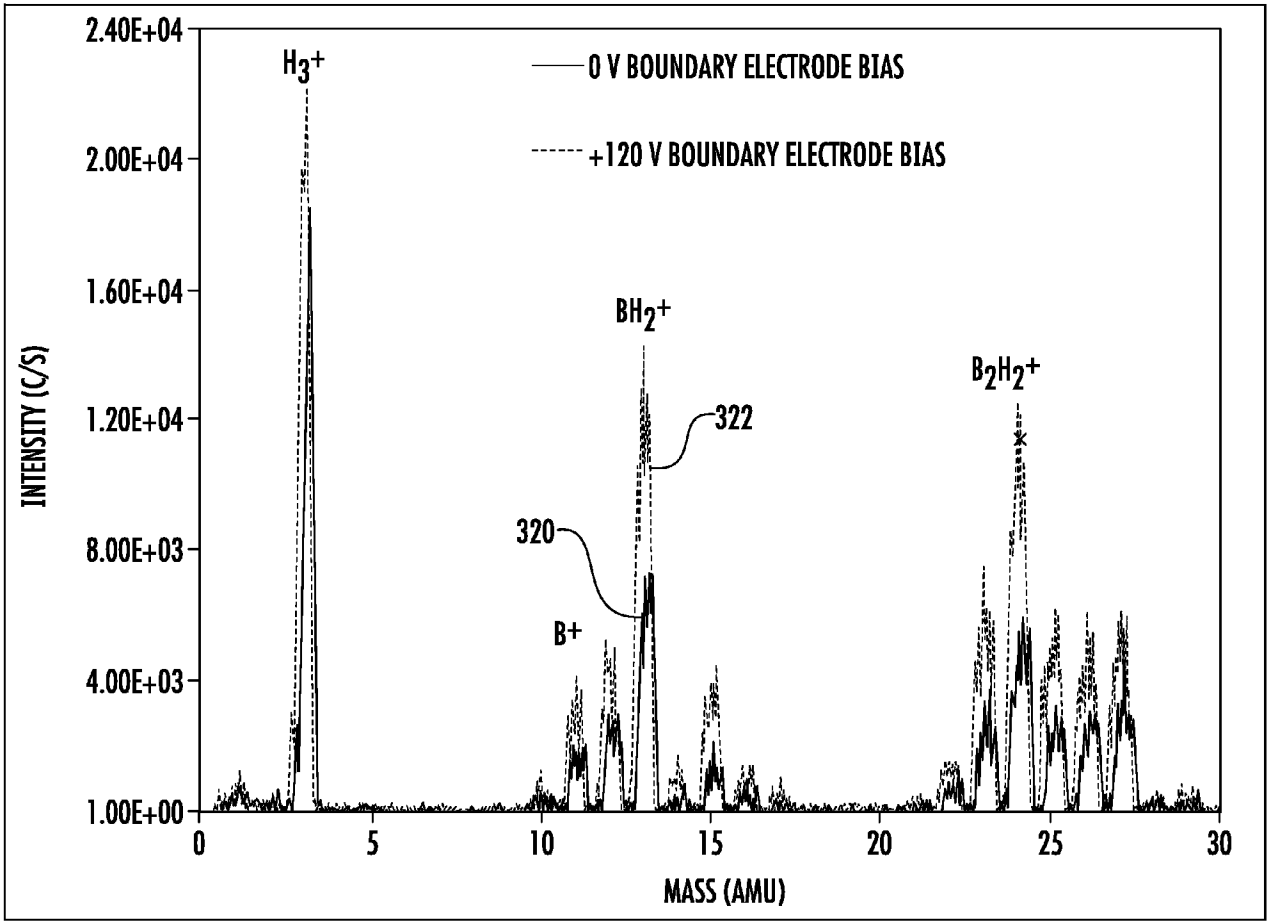
FIG. 3C depict mass spectra showing the increased generation of plasma species using an exemplary boundary electrode.

As discussed above in different embodiments boundary electrode voltage may be applied as a CW or pulsed signal. FIGS. 4A and 4B depict one scenario consistent with the present embodiments in which a pulsed extraction signal 402 is generated concurrently with a CW boundary electrode voltage signal 412. The pulsed extraction signal 402 includes a series of positive voltage pulses 404 that take place during ON portions 420 and zero voltage signals 406 that take place during OFF portions 418. In this case, the CW boundary electrode voltage signal 412 applies a constant positive bias voltage both during ON portions 420 and during OFF portions 418. The persistence of a positive bias during an OFF portion may result in higher ion current and ion energy for ions exiting the plasma as illustrated in FIG. 3B, 3C.

FIGS. 5A and 5B depict another scenario consistent with the present embodiments in which a pulsed extraction signal 402 is generated concurrently with a negative CW boundary electrode voltage signal 502. In this case, the CW boundary electrode voltage signal 412 applies a constant negative bias voltage 502 both during ON portions 508 and during OFF portions 510. The persistence of a negative bias during an OFF portion may result in lower ion current and lower ion energy as illustrated in FIG. 3A. This may have the effect of reducing (unwanted) ion dose of ions that exit the plasma during the OFF portion, thereby improving control of ion dose for a substrate being processed.

In other embodiments in which both extraction terminal voltage and boundary electrode voltage are provided as pulsed signals, the extraction terminal voltage and boundary voltage signals may be synchronized to one another to provide a repeated and reproducible variation in plasma properties as a function of time. During each "ON" portion, for example, a pulse of boundary electrode voltage may be used to adjust plasma properties.

Figure 6A:
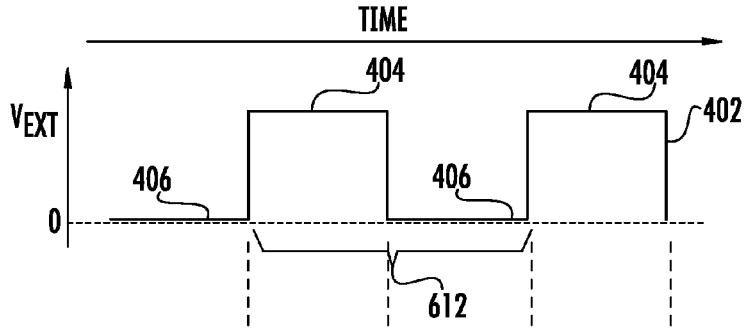
FIG. 6A depicts an exemplary extraction terminal voltage signal.
Figure 6B:
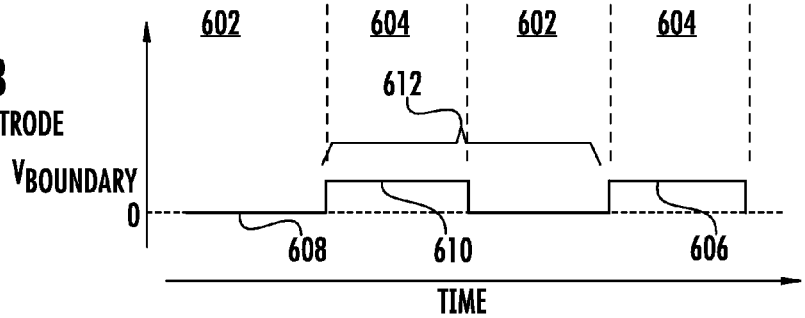
FIG. 6B depicts an additional exemplary boundary electrode voltage signal that may be used in conjunction with the extraction terminal voltage signal of FIG. 6A.

FIGS. 6A and 6B depict a further scenario consistent with the present embodiments in which the pulsed extraction signal 402 is synchronized with a pulsed boundary electrode voltage signal 606. Referring to FIG. 6A, a pulse period 612 is defined as a sum of a consecutive ON portion 604 and OFF portion 602. The pulsed boundary electrode voltage signal 606 includes positive voltage pulses 610 and zero voltage signals 608 that define a same pulse period 612 as that for the pulsed extraction signal 402. The pulsed boundary electrode voltage signal 606 is synchronized with the pulsed extraction signal 402 such that the positive voltage pulses 610 and zero voltage signals 608 are coincident with respective positive voltage pulses 404 and zero voltage signals 406.

Figure 7A:
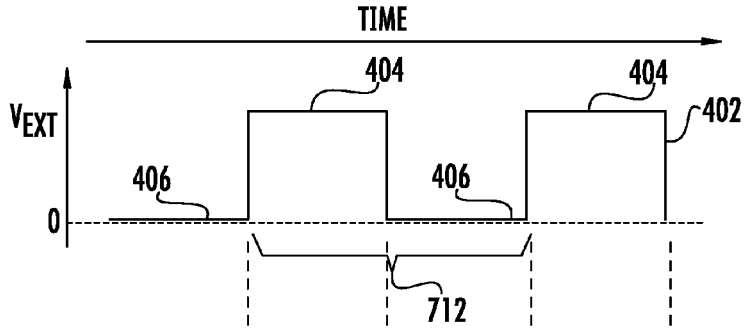
FIG. 7A depicts an exemplary extraction terminal voltage signal.
Figure 7B:
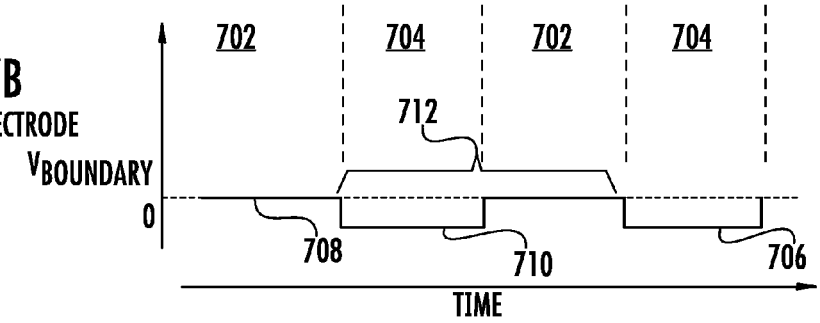
FIG. 7B depicts yet another exemplary boundary electrode voltage signal that may be used in conjunction with the extraction terminal voltage signal of FIG. 7A.

FIGS. 7A and 7B depict an additional scenario consistent with the present embodiments in which the pulsed extraction signal 402 is synchronized with a pulsed boundary electrode voltage signal 706. Referring to FIG. 7A, a pulse period 712 is defined as a sum of a consecutive ON portion 704 and OFF portion 702. The pulsed boundary electrode voltage signal 706 includes negative voltage pulses 710 and zero voltage signals 708 that define a same pulse period 712 as that for the pulsed extraction signal 402. The pulsed boundary electrode voltage signal 706 is synchronized with the pulsed extraction signal 402 such that the negative voltage pulses 710 and zero voltage signals 708 are coincident with respective positive voltage pulses 404 and zero voltage signals 406.

In other embodiments of synchronization, boundary electrode voltage may vary during "ON" portions of a pulse period. FIGS. 8A and 8B depict an additional scenario consistent with the present embodiments in which the pulsed extraction signal 402 is synchronized with a pulsed boundary electrode voltage signal 806. Referring to FIG. 8A, a pulse period 812 is defined as a sum of a consecutive ON portion 804 and OFF portion 802. The pulsed boundary electrode voltage signal 806 includes positive voltage pulse periods 810 and zero voltage signals 808 that define a same pulse period 812 as that for the pulsed extraction signal 402. The pulsed boundary electrode voltage signal 806 is synchronized with the pulsed extraction signal 402 such that the positive voltage pulse periods 810 and zero voltage signals 808 are coincident with respective positive voltage pulses 404 and zero voltage signals 406. However, each positive voltage pulse period 810 includes three different positive voltage signal portions 814, 816, and 818. Thus during each ON portion 604, the different sub-intervals are defined in which boundary electrode voltage varies while the extraction terminal voltage is constant. This may be useful to adjust the ion plasma properties during periods in which ions are extracted for implantation into a substrate. For example, in the scenario of FIG. 8B, the level of boundary voltage is lesser at the beginning (814) and ending (818) of each ON portion 604, and reaches a maximum level in a middle portion, positive voltage signal portion 816.

FIGS. 9A and 9B depict an additional scenario consistent with the present embodiments in which the pulsed extraction signal 402 is synchronized with a pulsed boundary electrode voltage signal 906. Referring to FIG. 9A, a pulse period 912 is defined as a sum of a consecutive ON portion 904 and OFF portion 902. The pulsed boundary electrode voltage signal 906 includes periodic positive voltage signal that is applied as positive voltage pulses 910 and zero voltage signals 908. In this example, the positive voltage pulses 910 span a duration of time that is less than the ON portion 904. However, the pulsed boundary electrode voltage signal 906 is nevertheless synchronized with the pulsed extraction signal 402 in that the positive voltage pulses 910 begin and end at the same relative instances $T_1$ and $T_2$ within each ON portion 904.

It is to be emphasized that the aforementioned embodiments of FIGS. 1-9B may generally produce global effects on a plasma and plasma processing system using boundary electrodes, such as modulating the plasma potential of a plasma and total ion current extracted from a plasma. However, consistent with various embodiments, boundary electrodes may be used to produce a spatial variation in plasmas and ion beams extracted from such plasmas. In some embodiments, one or more boundary electrodes are situated within a plasma chamber to adjust local plasma properties proximate the boundary electrode. In this manner, the boundary electrodes may also tailor the spatial variation in properties of ion beams extracted from the plasma.

Figure 10A:
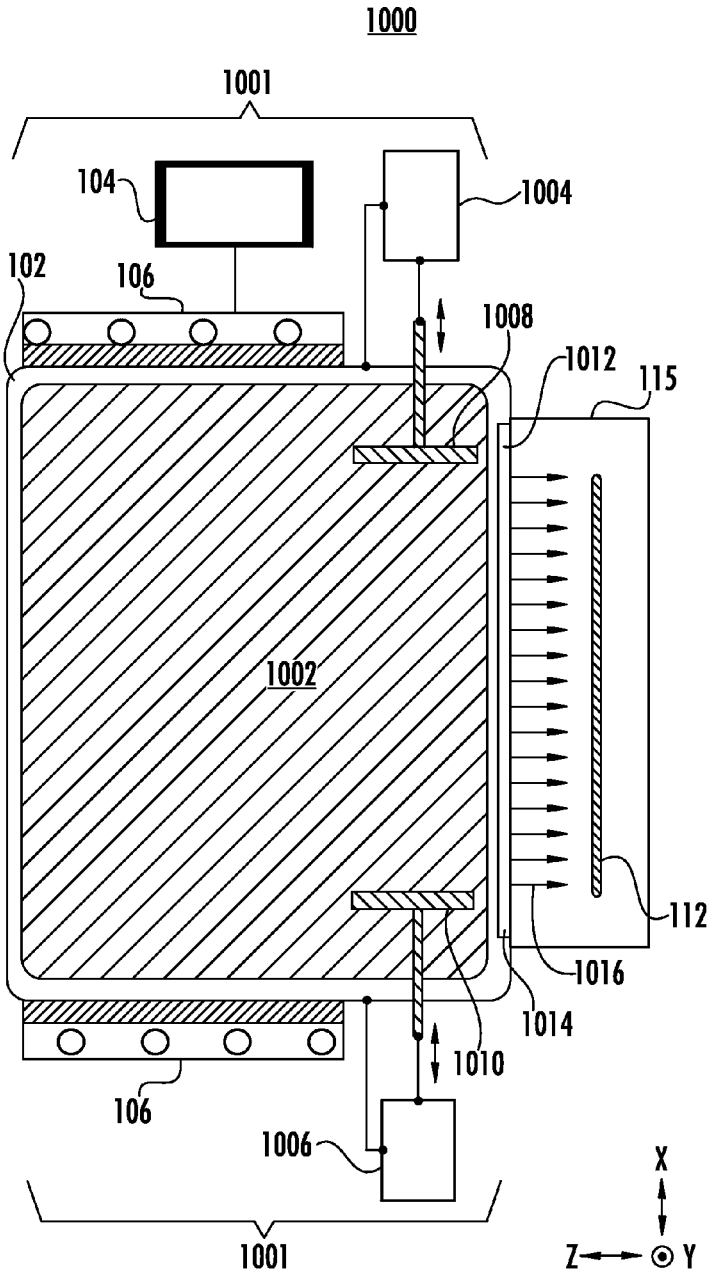
FIG. 10A is a schematic depiction of another exemplary processing system consistent with the present embodiments.

FIG. 10A depicts another exemplary processing system 1000 having multiple boundary electrodes consistent with the present embodiments. Except as otherwise noted, the processing system 1000 shares the same components as processing system 100 including the plasma chamber 102. In the processing system 1000, an extraction power supply 116 may be used to generate an extraction terminal voltage at the plasma chamber 102, but is omitted from FIG. 10 for clarity. Notably, FIG. 10 represents a top view of the plasma chamber 102 as opposed to the side view presented in FIGS. 1 and 2. Referring also to FIG. 1, the plasma chamber 102 is elongated in the X-direction as opposed to the Y-direction. The elongated dimensions in the X-direction facilitate use of an elongated extraction aperture (not shown) for extraction plate 110, which may be suitable to generate a ribbon ion beam or ribbon beam 1016. In this embodiment, the ion source 1001 includes a pair of boundary electrode power supplies 1004, 1006 that are coupled to respective boundary electrodes 1008, 1010, which are disposed adjacent opposite distal portions 1012, 1014 of the extraction plate 110.

Figure 10B:
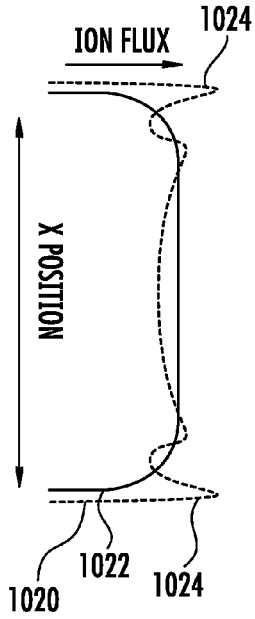
FIG. 10B depicts a conventional ion current profiles and exemplary ion current profile produced by an exemplary processing system.

When the ribbon beam 1016 is extracted from the plasma 1002, the ribbon beam may be scanned along the direction 126 (parallel to the Y-axis shown in FIG. 1) to expose the entire substrate 112 to ion treatment. It may be especially desirable for ion density to be uniform across the X-direction in order that each portion of the substrate 112 be exposed to the same flux of ions. Turning now to FIG. 10B there are shown exemplary curves representing ion flux as a function of position along the X-direction. The curves 1020 and 1022 may be representative of ion current extracted from the processing system 1000. In particular, the curve 1020 may represent ion flux extracted when no voltage is applied to the boundary electrodes 1008, 1010. In this case, edge effects inside the plasma chamber 102 or other effects may result in nonuniformities near the outer portions of the ribbon beam 1016. These nonuniformities can result in the large fluctuations in ion flux, especially near beam edges as exhibited by curve 1020. This non-uniformity in ion flux may result in creation of stripes of varying ion dose at different regions along the X-direction as the substrate is scanned along the Y-direction. This situation may be remedied by the application of voltage to the boundary electrodes 1008, 1010 which can alter the ion current locally in regions proximate the distal portions 1012, 1014 where the boundary electrodes 1008, 1010 are placed. For example, application of a small negative voltage to the boundary electrodes 1008, 1010 may locally reduce ion current so that the "horns" 1024 in the beam profile disappear, resulting in the more uniform current distribution shown in curve 1022.

In the example of FIG. 10A the boundary electrodes may be movable at least along the X-direction so that their position may be optimized to tune plasma characteristics for the purposes of modulating ion flux uniformity and/or ion energy in an ion beam extracted from the plasma chamber 102. In accordance with various embodiments this facilitates dynamic tuning of plasmas to optimize ion beam characteristics. For example, current density measurements and/or ion energy measurements may be performed as desired at a series of positions within the ribbon beam 1016. Ion beam current profiles and/or ion energy distributions resulting from such measurements may then be used to adjust voltages to be applied to the boundary electrodes 1008, 1010 and/or positions of the electrodes.

Figure 11:
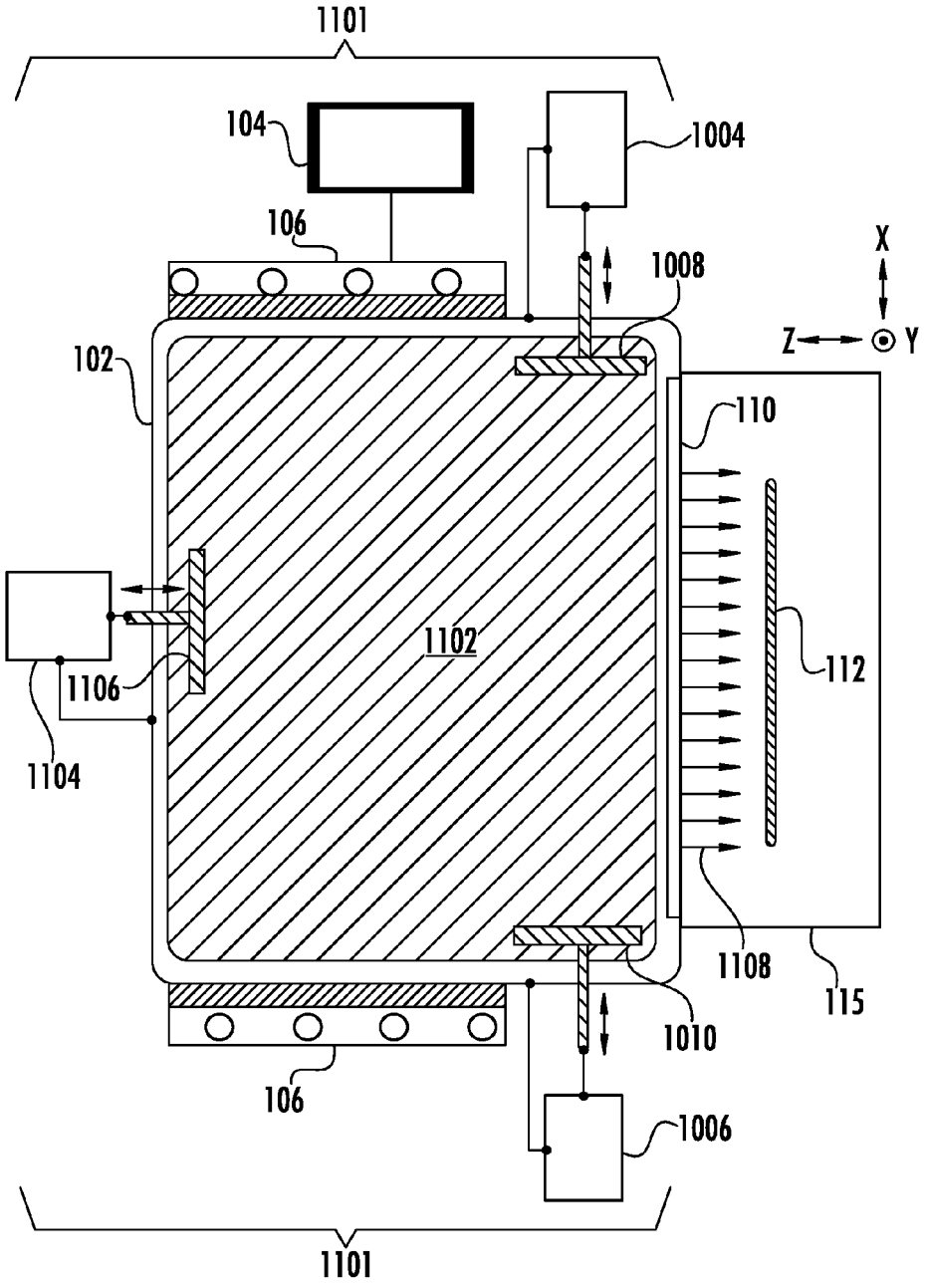
FIG. 11 is a schematic depiction of a further exemplary processing system consistent with the present embodiments.

In still further embodiments, a set of boundary electrodes may be arranged in any desirable set of locations within a plasma chamber to allow further control of plasma properties. FIG. 11 depicts another exemplary processing system 1100 in which the ion source 1101 includes three different boundary electrodes. In this example, the processing system 1100 is a variant of the processing system 1000 and includes the same components except as noted. As illustrated, in addition to the boundary electrodes 1008, 1010, the processing system 1100 includes a boundary electrode 1106 which receives voltage from the boundary electrode voltage supply 1104. When a plasma 1102 is generated in the plasma chamber 102, voltage may be applied to any number of the boundary electrodes 1008, 1010, 1106 to adjust plasma properties as desired. In addition, the boundary electrode 1106 may be movable along the Z direction to facilitate further control of plasma properties, which may generate an ion beam 1108 having desired ion flux profile, ion energy, ion energy distribution, and so forth.

In summary novel apparatus and techniques are presented that employ boundary electrodes to adjust plasma properties in a plasma processing system. The boundary electrodes may generate voltage pulses that are synchronized with power and/or voltage pulses used to generate a plasma and/or extract an ion beam from the plasma. The processing apparatus of the present embodiments facilitate the control of ion beam energy and/or ion flux uniformity in an ion beam by adjusting positive charge current drawn by the boundary electrodes or generated from the boundary electrodes. The control of ion current may in turn affect plasma properties globally, such as plasma potential, as well as local properties, such as ion density proximate a boundary electrode. The plasma control afforded by boundary electrodes may further affect time dependent plasma properties in pulsed operation mode, which may allow ion flux and ion energy to be minimized during OFF portions of pulse periods.

The methods described herein may be automated by, for example, tangibly embodying a program of instructions upon a computer readable storage media capable of being read by machine capable of executing the instructions. A general purpose computer is one example of such a machine. A non-limiting exemplary list of appropriate storage media well known in the art includes such devices as a readable or writeable CD, flash memory chips (e.g., thumb drives), various magnetic storage media, and the like.

The present invention is not to be limited in scope by the specific embodiments described herein. Indeed, other various embodiments of and modifications to the present disclosure, in addition to those described herein, will be apparent to those of ordinary skill in the art from the foregoing description and accompanying drawings.

Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the subject matter of the present disclosure should be construed in view of the full breadth and spirit of the present disclosure as described herein.

What is claimed is:

1. An ion source, comprising:

a chamber configured to house a plasma comprising ions to be directed through an aperture to a substrate;

an extraction power supply configured to apply an extraction terminal voltage to the chamber with respect to a voltage of a substrate positioned downstream of the chamber;

a boundary electrode voltage supply configured to generate a boundary electrode voltage different than the extraction terminal voltage; and a first boundary electrode disposed within the chamber adjacent a first distal portion of the aperture and electrically coupled to the boundary electrode voltage supply, the boundary electrode configured to alter plasma potential of the plasma when the boundary electrode voltage is received; and a second boundary electrode disposed within the chamber adjacent a second distal portion of the aperture and configured to apply a second boundary electrode voltage different than the extraction terminal voltage.

2. The ion source of claim 1, wherein the boundary electrode is configured to adjust local ion density in at least a portion of the plasma.

3. The ion source of claim 1, further comprising one or more additional electrodes disposed at one or more respective additional locations within the chamber and configured to apply a respective boundary electrode voltage different than the extraction terminal voltage.

4. The ion source of claim 1, wherein the boundary electrode and second boundary electrode are configured to move generally parallel to the long direction.

5. The ion source of claim 1, further comprising an extraction aperture to extract the ions from the plasma, wherein the boundary electrode is disposed in a portion of the chamber opposite the extraction aperture.

6. The ion source of claim 1, wherein the extraction power supply is configured to supply the extraction terminal voltage as a pulsed extraction terminal voltage signal, and the boundary electrode is configured to supply the boundary electrode voltage as a constant boundary electrode voltage or as a pulsed boundary electrode voltage signal that is synchronized to the pulsed extraction terminal voltage signal.

7. The ion source of claim 6, wherein the pulsed extraction terminal voltage signal comprising an extraction terminal voltage period having an ON portion in which the extraction terminal voltage signal is positive respect to the substrate voltage and OFF portion in which the extraction terminal voltage signal is equal to the substrate voltage, wherein the boundary electrode voltage signal comprises a pulsed boundary electrode voltage signal having a boundary electrode period equal to the extraction terminal voltage period.

8. The ion source of claim 7, wherein the boundary electrode voltage signal comprising a periodic positive voltage pulse that takes place within the ON portion of the extraction terminal voltage period and spans a duration less than that of the ON portion of the extraction terminal voltage period.

9. The ion source of claim 7, wherein the boundary electrode voltage signal comprising an ON portion that includes a plurality of subportions in which boundary electrode voltage varies between subportions.

10. The ion source of claim 1, wherein an absolute value of the difference between the boundary electrode voltage and extraction terminal voltage comprising five hundred volts or less.

11. The ion source of claim 1, wherein a ratio of electrode surface area of the boundary electrode to area of internal chamber walls of the chamber is about 1% to about 30%.

12. The ion source of claim 1, further comprising an extraction electrode configured to extract an ion beam from the plasma, wherein the boundary electrode is configured to adjust and uniformity of ions within the ion beam.

13. A method of processing a substrate, comprising:

generating a plasma in a chamber, the plasma comprising ions to be directed to the substrate;

applying an extraction terminal voltage between the chamber and substrate, the extraction terminal voltage effective to generate a first plasma potential in the plasma;

generating a first boundary electrode voltage at a first boundary electrode disposed within the chamber, the first boundary electrode voltage different than the extraction terminal voltage and generated at least partially during the applying the extraction terminal voltage, the first boundary electrode voltage effective to generate a second plasma potential for the plasma that is different from the first plasma potential; and generating one or more additional boundary electrode voltages at a respective one or more additional boundary electrodes disposed at one or more respective additional locations within the chamber, wherein each respective boundary electrode voltage of the one or more additional boundary electrode voltages is different than the extraction terminal voltage.

14. The method of claim 13, further comprising:

supplying the extraction terminal voltage as a pulsed extraction terminal voltage signal, and supplying the boundary electrode voltage as a constant boundary electrode voltage or as a pulsed boundary electrode voltage signal that is synchronized to the pulsed extraction terminal voltage signal.

15. The method of claim 14, the generating the plasma comprising sending a pulsed power signal to generate the plasma as a pulsed plasma, the method further comprising synchronizing the pulsed power signal to the pulsed extraction terminal voltage signal.

16. The method of claim 14, further comprising:

generating the pulsed extraction terminal voltage signal as a periodic signal comprising an extraction terminal voltage period having an ON portion in which the extraction terminal voltage signal is positive with respect to the substrate voltage and OFF portion in which the extraction terminal voltage signal is equal to the substrate voltage; and generating the boundary electrode voltage signal as a pulsed boundary electrode voltage signal having a boundary electrode period equal to the extraction terminal voltage period.

17. The method of claim 16, further comprising generating a voltage pulse at the boundary electrode within the ON portion of the extraction terminal voltage period, wherein a duration of the voltage pulse is less than a duration of the ON portion.

18. The method of claim 16, further comprising varying the boundary electrode voltage between two or more boundary electrode voltage levels within the ON portion of the extraction electrode period.

19. The method of claim 13, wherein an absolute value of the difference between the boundary electrode voltage and extraction terminal voltage is less than 500 volts.

20. The method of claim 14, further comprising moving the substrate with respect to the chamber; and adjusting the pulsed extraction terminal voltage signal to generate a patterned ion exposure of the substrate.

21. The method of claim 16, further comprising adjusting the boundary electrode voltage during at least an OFF portion of the pulsed extraction terminal voltage signal to reduce ion dose of ions that exit the plasma during the OFF portion.

* * * * *